United States Patent [19]

Vann

[11] 4,066,282

[45] Jan. 3, 1978

[54] POSITIVE TUBING RELEASE COUPLING

[76] Inventor: Roy R. Vann, Box 38, Artesia, N. Mex. 88210

[21] Appl. No.: 691,384

[22] Filed: June 1, 1976

Related U.S. Application Data

[63] Continuation-in-part of Ser. No. 517,391, Oct. 23, 1974, Pat. No. 3,966,236.

[51] Int. Cl.[2] ..... F16L 37/08

[52] U.S. Cl. ..... 285/39; 285/315; 285/319

[58] Field of Search ..... 285/39, 319, 33, 34, 285/391, 315, 309, 310; 166/297

[56] References Cited

U.S. PATENT DOCUMENTS

| | | | |
|---|---|---|---|
| 2,409,811 | 10/1946 | Taylor, Jr. et al. | 285/315 X |
| 2,532,686 | 12/1950 | Ware | 285/391 X |
| 2,737,248 | 3/1956 | Baker | 285/34 |
| 3,071,188 | 1/1963 | Raulins | 285/34 X |
| 3,136,366 | 6/1964 | Brown et al. | 285/319 X |
| 3,148,894 | 9/1964 | Schwab | 285/319 X |

*Primary Examiner*—Thomas F. Callaghan
*Attorney, Agent, or Firm*—Marcus L. Bates

[57] ABSTRACT

A positive tubing releasable coupling apparatus which is interposed within a tubing string, and the string subsequently parted by separating various component parts of the coupling from one another. A wireline fishing tool is used for actuating the releasing mechanism.

12 Claims, 6 Drawing Figures

POSITIVE TUBING RELEASE COUPLING

REFERENCE TO RELATED PATENT APPLICATIONS

This is a continuation in part of my copending patent application Ser. No. 517,391, filed Oct. 23, 1974, now U.S. Pat. No. 3,966,236.

BACKGROUND OF THE INVENTION

In my copending patent application it was pointed out that one can often foresee that a lower marginal part of a tool string must subsequently be disconnected from the remainder of the string and left downhole in the borehole. This is especially so in well completion work, wherein the lower tubing string must sometimes be severed by employment of explosive devices, and the lower string is dropped to the bottom of the hole. An important example of the desirability of separating a tool or pipe string is also found in my issued U.S. Pat. No. 3,706,344, to which reference is made for further background of this invention.

Accordingly, it is desirable to be able to separate a tool string at any predetermined location along its length. It is further desirable that the separation of the string be achieved while avoiding explosives because of the inherent dangers associated with the use of explosive devices, especially when used downhole in boreholes. Moreover, it is especially desirable that the separation of the string be effected by a wireline operation, and that it be brought about in an inexpensive and foolproof manner.

SUMMARY OF THE INVENTION

This invention relates to downhole tools, and specifically to a fluid conducting, releasable coupling apparatus which can be interposed within a tool string for subsequently parting the string at a predetermined location along its length by manipulation of the invention with a wireline fishing tool. The tool of the present invention includes a female member which telescopingly receives a male member therewithin. The telescoping marginal end portion of the male and female members cooperate together to form a load transferring member which is held together by a releasing member. The releasing member and load transferring members are concentrically arranged relative to one another so that a fishing tool can engage and move the releasing member, thereby allowing the male and female load transferring members to telescopingly move apart from one another.

A marginal interior portion of the female member is threaded, while a marginal outer surface of the male member is provided with a complementary threaded area. The threaded area of the male member is in the form of a plurality of elongated fingers and are formed by a series of radially spaced, longitudinal cutouts which leave radially spaced, longitudinally disposed lands. The fingers may be urged radially inwardly towards one another to thereby permit the coacting threaded surfaces to move respective to one another, so that the male and female members axially move apart upon removal of the releasing member.

Accordingly, a primary purpose of this invention is the provision of a fluid conducting releasable coupling which ties together a tubing string in a releasable manner.

Another object of the invention is to provide a wireline actuated releasable coupling apparatus.

A further object of this invention is to provide a releasable coupling member having an internal member which is axially movable to cause one part of the coupling to be released from another part of the coupling.

A still further object of the invention is to provide a releasable coupling assembly having an unobstructed axial passageway formed therethrough, and which transfers torque through a tubing string.

Still another object of the invention is the provision of a releasable coupling which is a sealed flow passageway and which can transfer both tension and torque.

An additional object of this invention is to disclose and provide a releasable coupling which can be parted in a more reliable and positive manner than was heretofore realized.

The above objects of the invention are attained by the provision of telescoping members tied together by a load carrying member with the load carrying member being held in position by a releasing member, all of which are concentrically arranged respective to one another, in a manner whereby movement of the releasing member enables the telescoping members to be untied from one another.

DETAILED DESCRIPTION OF THE PREFERRED EMBODIMENT

Figure 1:
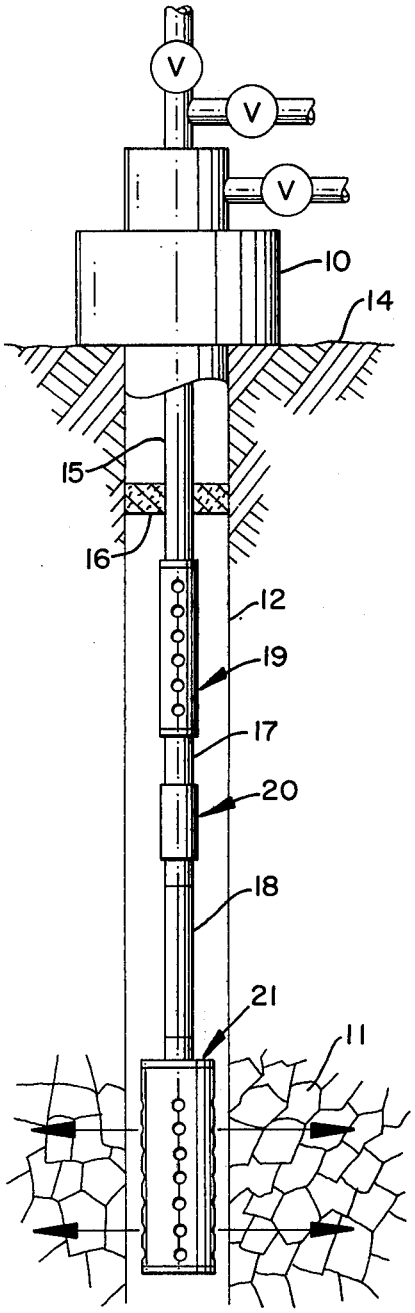
FIG. 1 is a part schematical, part diagrammatical representation of a borehole formed within the earth, with apparatus made in accordance with the present invention being disposed therewithin.

In FIG. 1 there is disclosed a wellhead or christmas tree 10 in fluid communication with an oil producing strata 11 by means of borehole 12 which extends through the surface of the ground 14 so that production fluid can flow uphole through a production tubing 15.

A packer device 16 separates the upper and lower bore-hole annulus and receives the production tubing therethrough. The production tubing continues at 17 and 18 in order to connect a vent string 19 to a releasable coupling 20 made in accordance with the present invention. Perforating gun 21 is connected to the releasable coupling and can be separated from the vent string at any subsequent time by manipulating the releasable coupling of this invention with a wireline actuated fishing tool of a type known to those skilled in the art.

Figure 2:
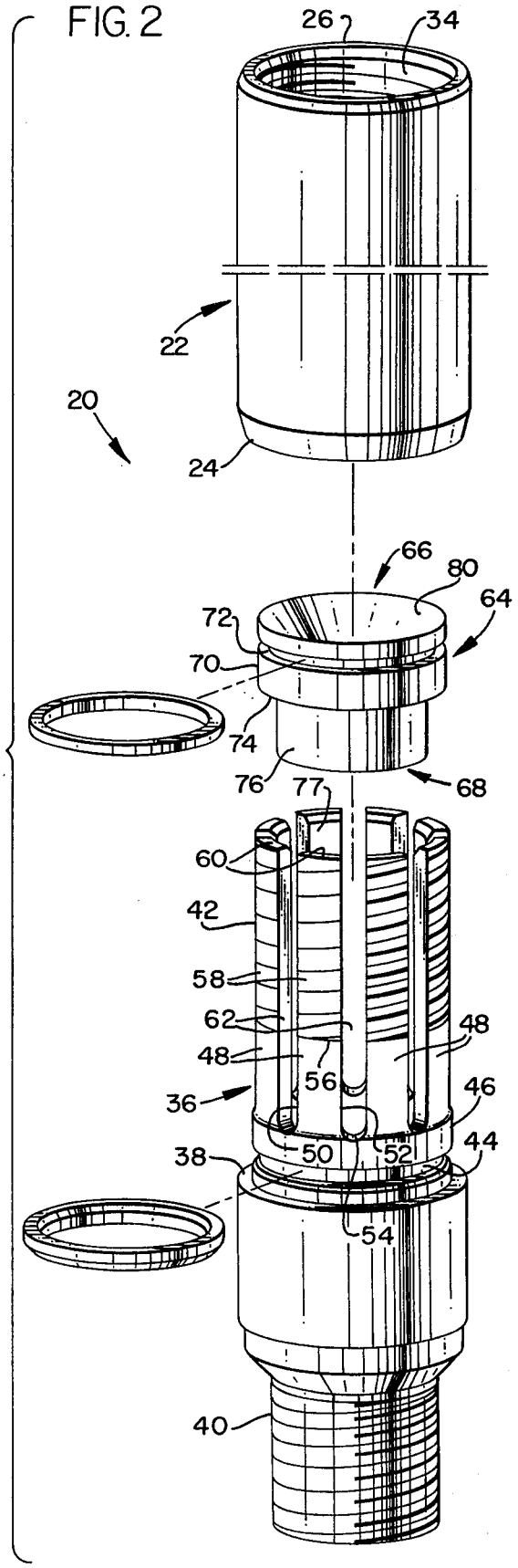
FIG. 2 is an enlarged, exploded, perspective view of part of the apparatus disclosed in FIG. 1.
Figure 3:
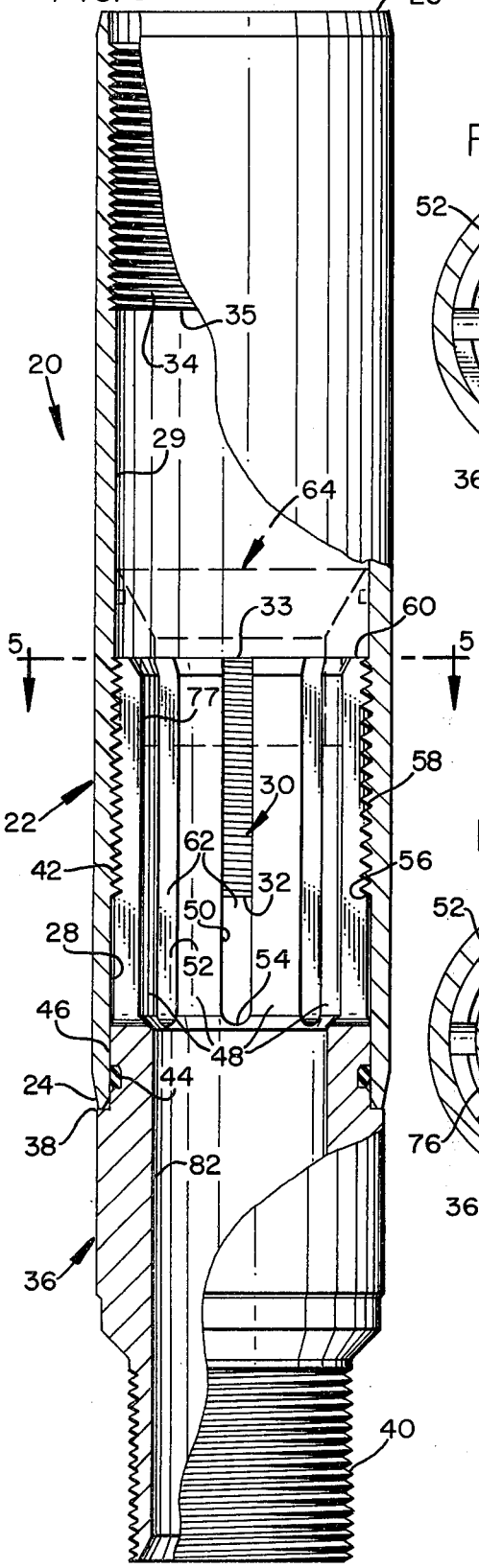
FIGS. 3 and 4 are enlarged, longitudinal, part cross-sectional representations of part of the apparatus disclosed in FIGS. 1 and 2, with some parts being removed therefrom; and, FIGS. 5 and 6, respectively, are cross-sectional views taken along lines 5—5 of FIG. 3 and 6—6 of FIG. 4, respectively.
Figure 5:
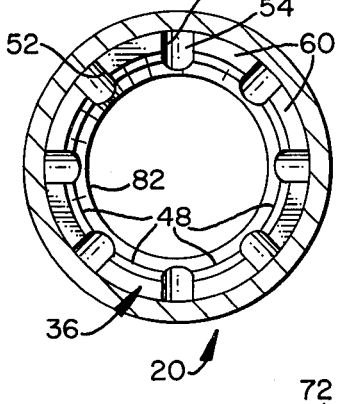
Figure 6:
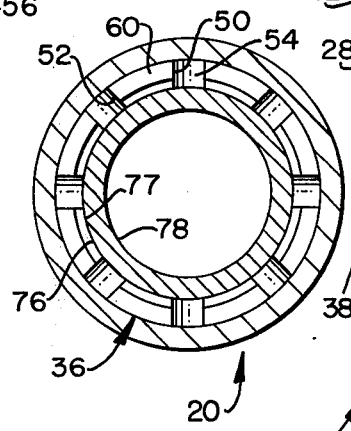
Figure 4:
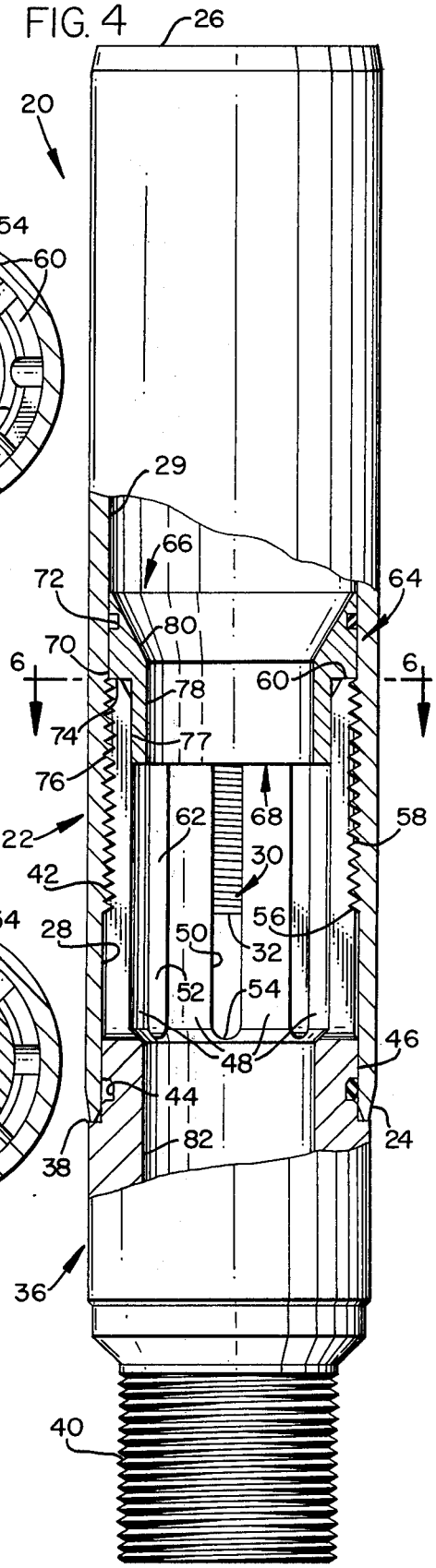

FIGS. 2–6 disclose the details of the releasable coupling seen at 20 in FIG. 1. As seen in FIG. 2, in conjunction with some of the remaining figures, the coupling comprises a pair of load transferring members which include a female sub 22 having a lower end portion 24, and an upper end portion 26, often called the box end. As best seen in FIGS. 3 and 4, the female coupling has an interior lower marginal portion 28 spaced from a medial, marginal, smooth bore 29 by a threaded marginal length 30. The threads extend from 32 to 33. The upper marginal end of the female sub is provided with threads 34 which commence near end portion 26 and terminate at 35.

Male member 36 forms the remaining load transferring member and is provided with a circumferentially extending shoulder 38 which abuttingly engages the lower terminal end 24 of the female member. The lower marginal end of the male sub is threaded to form the pin end 40, thereby enabling the apparatus to be interposed within an ordinary string of production tubing or the like.

As best seen in FIGS. 2, 3, and 4, the telescoping marginal end of the male member is threaded at 42. A circumferentially extending groove 44 is formed within the reduced constant diameter portion 46 which separates the threads 42 from the shoulder 38, thereby providing an adequate marginal length of surface on the male member for accommodating the illustrated seal thereon.

A plurality of radially spaced-apart lands 48 extend from the constant diameter portion 46 and are defined by spaced, parallel sidewalls 50 and 52. The lands are joined together at 54. The threaded area commences at 56 in spaced relationship to the joinder member 54, and terminates at the terminal end 60 of the male member.

Accordingly, cutouts 62 are formed in radially spaced relationship about the male member, with the cutouts terminating at 54 to thereby form a series of longitudinally aligned, radially spaced, upwardly opening grooves which define the before mentioned fingers.

A releasing member 64 preferably includes an upper conical surface which downwardly converges into a central passageway. The passageway is of constant i.d. and terminates at the lower end 68 thereof. The large o.d. portion 70 has a circumferentially extending groove 72 circumferentially formed therein for receiving the illustrated seal therewithin. Shoulder 74 of the releasing member is formed between the large o.d. 70 and small o.d. 77 of the member. The shoulder is received in seated relationship against the upper terminal end 60 of the fingers in the illustrated manner of FIGS. 3 and 4. Surface 80 of the conical portion of the releasing member is arranged whereby there is no likelihood of inadvertent engagement with tool strings which may be lowered down through the releasing member.

OPERATION

In operation, the apparatus of the present invention is preferably arranged in the manner of FIGS. 2, 3, and 4, although it would be possible to use the releasing member in the inverted configuration. When inverted, the configuration of the releasing member 64 would preferably be modified so that the relationship of the conical surface 80 and the end 68 is reversed.

The male member is fabricated by turning the threaded area 58 prior to milling the cutouts 62 therein to thereby provide the individual fingers with a well-defined threaded area. The threaded area is calculated whereby the pitch and depth, as well as the number of threads, are of a value which is at least equal to the breaking strength of the tubing 18. In this respect, the resultant structure provided by the individual fingers must likewise have a breaking strength equivalent to the breaking strength of the tubing string 15 or 18. Those skilled in the art can calculate the wall thickness of the fingers and the permissible cutout area, as well as the configuration, depth, and number of threads.

The term "threaded area 58" is intended to include individual, circumferentially spaced-apart grooves, as well as a continuous thread which extends from 60 to 56.

The apparatus is assembled by screwing the male and female members together with a suitable gasket being placed within the annular groove 44 so that the resultant structure provides a sealed fluid coupling having a pin end at 40 and box end at 26 in the conventional manner of a tool string sub. The releasing member 64 is next provided with the illustrated resilient seal and slidably placed into the illustrated position seen in FIGS. 3 and 5.

With the apparatus in the configuration illustrated in FIG. 4, the individual fingers are urged outwardly into engagement with the threaded area formed on the female member and consequently, the two members are effectively tied together in a positive manner. The releasable coupling is interposed within a tool string, such as exemplified by FIG. 1, and when it is desired to release a lower maginal length 18 of the string from an upper marginal length 17, a fishing tool can be run downhole in the usual manner until the fishing tool passes through the releasing member. When the wireline actuated fishing tool is picked up, the lower end 68 of the releasing member is engaged by the tool and the releasing member is moved uphole out of engagement with the fingers. Upper end 66 of the releasing member generally will engage the lower, circumferentially extending shoulder presented by the tubing string 17 to thereby form a positive stop means which abuttingly engages the upper shoulder of the releasing member.

The foregoing manipulative action removes the outward force exerted upon the individual fingers, thereby enabling the fingers to yieldably move towards one another so that the threaded surfaces at 42 and 58 can move laterally of one another, thereby enabling the male member to telescope or slide apart from the female member. This action releases the lower male member, along with everything connected thereto so that the lower tubing string 18, along with the gun 21, is dropped to the bottom of the borehole, while the female member remains connected to the upper tubing string 17.

An important feature of the present invention lies in providing an elongated plurality of fingers having a cutout which extends well below the threads 58 to thereby present a finger length which extends from 54 up to the beginning of the threaded area at 56. This feature of the invention provides an elongated finger having a threaded outer marginal end portion spaced from a main body portion such that the threaded area of the individual fingers can be resiliently urged towards one another by the action of the male and female members being pulled apart axially from one another.

Stated differently, the pitch of the threads 58 provides a wedgelike action which maintains the members joined together so long as the releasable member maintains the coacting threads interlocked with one another; and, when the releasing member is removed, the resultant force causes the individual fingers to be resiliently urged towards one another, thereby enabling the coacting threaded surfaces to move laterally respective to one another, so that the male and female members are parted.

After the male and female members have been parted, the fishing tool can be removed from the apparatus in any number of different manners known to those skilled in the art of fishing tools. The O-ring placed within groove 72 of the releasing member prevents inadvertent movement while a trip is being made through the releasable coupling with various different tools.

I claim:

1. A wireline actuated, releasable coupling apparatus which can be interposed within a tool string for subsequently parting one marginal length of the string from the other, comprising:

a female member having an end for attachment into an upper marginal length of a tool string;

a male member having an end for attachment into a lower marginal length of a tool string;

a marginal lower end of said female member and a marginal upper end of said male member being of a diameter which permits them to be telescopingly joined together, one within the other;

a releasing member; said releasing member having a marginal upper end of a relative large O.D. for slidably engaging the interior wall surface of said female member, and a marginal lower end of a relative small O.D. for slidably engaging the interior surface of said male member, there being a shoulder formed between said large O.D. and small O.D. upper and lower ends;

said female member, said male member, and said releasing member being concentrically arranged respective to one another, means forming an axial passageway through said female member, said male member, and said releasing member; said large O.D. end and small O.D. end, respectfully, of said releasing member being slidably received within at least a portion of said marginal lower end and marginal upper end, respectively, of said female and male members, respectively;

a plurality of radially arranged fingers jointly formed by said marginal upper end of said male member, said small O.D. marginal end of said releasing member being interposed between said fingers and said axial passageway to urge said fingers against said marginal lower end of said female member;

said releasing member having an upper conical entrance spaced from a lowermost circumferentially extending end portion, said shoulder of said releasing member abuttingly engages the upper terminal end of said male member, said lowermost circumferentially extending end of said releasing member forms a shoulder which a fishing tool can engage;

a marginal exterior wall of said fingers and a marginal interior wall of said female member having coacting threads formed thereon which mutually engage one another; whereby, said releasing member can be moved axially to allow said fingers to resistingly move towards one another, whereupon said male and female members slide apart from one another, thereby releasing said male and female members from one another.

2. The releasable coupling apparatus of claim 1 wherein said fingers are formed by a plurality of radially spaced cutouts which extend from the upper terminal end of said male member to a location spaced from said threaded surface formed on the exterior of said male member to thereby enable the entire threaded surface of each finger to be moved radially towards the axial centerline of the male member an amount to enable the coacting threaded surfaces to move laterally respective to one another.

3. The releasable coupling apparatus of claim 1 wherein said fingers are parallel to one another and to the longitudinal central axis of said male and female members;

said fingers having sidewalls formed by a cutout which extends a distance substantially greater than the threaded area formed on said finger to thereby enable the threaded portion of said fingers to be yieldably forced towards one another an amount which is greater than the depth of said threads, to thereby achieve sliding telescoping movement between said male and female members when said releasing member is removed from contact with said male member.

4. The releasable coupling of claim 3 wherein a circumferentially extending shoulder and an annular groove are included on said male member in spaced relationship to said fingers; said annular groove being located between said circumferentially extending shoulder and said fingers; and a seal means located within said annular groove;

the lowermost end of said female member being abuttingly received against said shoulder.

5. The releasable coupling of claim 4 wherein the threaded area in said female member is spaced from the lower end thereof an amount to accommodate the constant diameter portion within which said seal means is located.

6. The releasable coupling of claim 1 wherein said male member includes a circumferentially extending shoulder and an annular groove which are located in spaced relationship respective to said fingers; said annular groove being located between said circumferentially disposed shoulder and said fingers; and a seal means positioned within said annular groove;

the lowermost end of said female member being abuttingly received against said shoulder;

the threaded area on said female member being spaced from the lower end thereof an amount to accommodate the constant diameter portion of said male member within which said seal means is located.

7. A releasable, sealed, fluid conveying coupling apparatus having opposed ends which can be connected into a tool string so that the tool string can be subsequently parted;

said coupling apparatus including a female member which telescopingly receives a marginal length of a male coupling;

said male coupling having a marginal end made into the form of a plurality of fingers which are radially spaced apart and can be forced to yieldably move towards one another, said fingers being located on said marginal end of said male member which is telescopingly received within said female member;

means forming a threaded surface on the interior of said female member, means forming a threaded surface on the exterior of said fingers, the threads on said male and female members being complementary respective to one another to enable the threaded surfaces to threadedly engage one another;

a releasing member having a reduced diameter lower marginal end slidably received within a marginal end portion of said fingers to force the fingers radially outwards to cause the threaded surfaces to threadedly engage one another; said releasing member having an enlarged diameter at the upper marginal end which is slidably received within said female member, there being a shoulder formed between said enlarged and reduced diameter marginal end for abuttingly engaging the threaded terminal end of said male coupling; said releasing member being movable away from said fingers to release the force which causes the fingers to be forced radially outwards;

so that when the lower end of said releasing member is engaged by a wireline tool and moved away from the fingers and said male and female members are pulled apart with sufficient force, the threaded surfaces will move laterally respective to each other to thereby cause the male member to be released from the female member.

8. The fluid conveying apparatus of claim 7 wherein said fingers are formed by a plurality of radially spaced cutouts which extend from the upper terminal end of said male member to a location spaced from said threaded surface formed on the exterior of said male member to thereby enable the entire threaded surface of each finger to be moved radially towards the axial centerline of the male member an amount to enable the coacting threaded surfaces to move laterally respective to one another.

9. The fluid conveying apparatus of claim 7 wherein said fingers are parallel to one another and to the longitudinal central axis of said male and female members;

said fingers having sidewalls formed by a cutout which extends a distance substantially greater than the threaded area formed on said finger to thereby enable the threaded portion of said fingers to be yieldably forced towards one another an amount which is greater than the depth of said threads, to thereby achieve sliding telescoping movement between said male and female members when said releasing member is removed from contact with said male member.

10. The fluid conveying apparatus of claim 9 wherein a circumferentially extending shoulder and an annular groove are included on said male member in spaced relationship to said fingers; said annular groove being located between said circumferentially extending shoulder and said fingers; and a seal means located within said annular groove;

the lowermost end of said female member being abuttingly received against said shoulder.

11. The fluid conveying apparatus of claim 10 wherein the threaded area in said female member is spaced from the lower end thereof an amount to accommodate the constant diameter portion within which said seal means is located.

12. The fluid conveying apparatus of claim 7 wherein said male member includes a circumferentially extending shoulder and an annular groove which are located in spaced relationship respective to said fingers; said annular groove being located between said circumferentially disposed shoulder and said fingers; and a seal means positioned within said annular groove;

the lowermost end of said female member being abuttingly received against said shoulder;

the threaded area on said female member being spaced from the lower end thereof an amount to accommodate the constant diameter portion of said male member within which said seal means is located.

* * * * *